US011976405B2

(12) United States Patent
Jang et al.

(10) Patent No.: US 11,976,405 B2
(45) Date of Patent: May 7, 2024

(54) LAUNDRY TREATING APPARATUS

(71) Applicant: LG Electronics Inc., Seoul (KR)

(72) Inventors: Hosung Jang, Seoul (KR); Yohwan Kang, Seoul (KR); Donghwa Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 487 days.

(21) Appl. No.: 17/199,900

(22) Filed: Mar. 12, 2021

(65) Prior Publication Data

US 2021/0285148 A1 Sep. 16, 2021

(30) Foreign Application Priority Data

Mar. 12, 2020 (KR) ..... 10-2020-0030915

(51) Int. Cl.
*D06F 39/00* (2020.01)
*D06F 23/02* (2006.01)
*D06F 39/14* (2006.01)

(52) U.S. Cl.
CPC ..... *D06F 39/14* (2013.01); *D06F 23/02* (2013.01)

(58) Field of Classification Search
CPC ..... D06F 39/14; D06F 39/08; D06F 41/00; D06F 23/00; D06F 23/02; D06F 25/00; D06F 27/00; D06F 29/00; D06F 29/005; D06F 29/02; D06F 31/00
See application file for complete search history.

(56) References Cited

U.S. PATENT DOCUMENTS

| | | | | |
|---|---|---|---|---|
| 10,301,760 | B2 * | 5/2019 | Kim | D06F 39/14 |
| 10,676,857 | B2 * | 6/2020 | Heater | D06F 39/14 |
| 10,907,397 | B1 * | 2/2021 | Jones | D06F 39/14 |
| 11,560,668 | B2 * | 1/2023 | Kwon | D06F 58/20 |
| 2006/0265959 | A1 * | 11/2006 | Renzo | D06F 39/14 49/381 |

(Continued)

FOREIGN PATENT DOCUMENTS

| | | |
|---|---|---|
| CN | 101168903 | 4/2008 |
| CN | 103290658 | 9/2013 |

(Continued)

OTHER PUBLICATIONS

Extended European Search Report in European Appln. No. 21161688.3, dated Jun. 9, 2021, 10 pages.

(Continued)

*Primary Examiner* — Chi Q Nguyen
(74) *Attorney, Agent, or Firm* — Fish & Richardson P.C.

(57) ABSTRACT

A laundry treating apparatus includes a main body provided with a front cover having a laundry inlet port and a door rotatably installed on the front cover to open and close the laundry inlet port. The door includes an outer frame disposed toward an outside of the main body, a front glass provided on a front surface of the outer frame, an inner frame disposed toward an inside of the main body and coupled to a rear surface of the outer frame, and a handle that is recessed radially inward from side surfaces of the outer frame and the inner frame to form a space for putting fingers. As the front cover has a curved shape, an installation area of the handle may be efficiently acquired even when an installation space of the handle is small.

20 Claims, 14 Drawing Sheets

(56) References Cited

U.S. PATENT DOCUMENTS

| | | | | |
|---|---|---|---|---|
| 2010/0088917 | A1* | 4/2010 | Lim | D06F 58/04 34/88 |
| 2011/0120195 | A1* | 5/2011 | Jeoung | D06F 37/28 68/139 |
| 2015/0000200 | A1* | 1/2015 | Kim | E05B 5/006 49/460 |
| 2015/0115630 | A1* | 4/2015 | Tarr | D06F 34/20 292/251.5 |
| 2015/0233042 | A1* | 8/2015 | Kang | D06F 39/14 312/228 |
| 2020/0248396 | A1* | 8/2020 | Kwon | E05B 65/006 |

FOREIGN PATENT DOCUMENTS

| | | |
|---|---|---|
| CN | 105908453 | 8/2016 |
| CN | 208293271 | 12/2018 |
| CN | 104975466 | 2/2019 |
| CN | 110761051 | 2/2020 |
| DE | 202013000222 | 2/2013 |
| EP | 1860228 | 11/2007 |
| FR | 2733258 | 10/1996 |

OTHER PUBLICATIONS

Office Action in Korean Appln. No. 10-2020-0030915, dated Jun. 15, 2021, 9 pages (with English translation).
Office Action in Chinese Appln. No. 202110259549.2, dated Nov. 9, 2022, 22 pages (with English translation).

* cited by examiner

LAUNDRY TREATING APPARATUS

CROSS-REFERENCE TO RELATED APPLICATION

Pursuant to 35 U.S.C. § 119(a), this application claims the benefit of the earlier filing date and the right of priority to Korean Patent Application No. 10-2020-0030915, filed on Mar. 12, 2020, the contents of which are incorporated by reference herein in their entirety.

TECHNICAL FIELD

The present disclosure relates to a laundry treating apparatus having a handle provided on a door to pull the door.

BACKGROUND

In general, a laundry treating apparatus may include an apparatus having a function of washing or drying laundry or other items (hereinafter, collectively "laundry"). In addition, the laundry treating apparatus may be configured to have both a washing function and a drying function of the laundry.

The laundry treating apparatus may include a main body having a laundry inlet port, a door configured to open and close the laundry inlet port, and a laundry accommodating portion provided in the main body.

The door may include a door frame, a front glass attached to a front surface of the door frame, and a door window that is mounted on the door frame and protrudes through the laundry input port.

The door frame may include an outer frame disposed toward an outside of the main body, and an inner frame disposed toward an inside of the main body when the door is closed.

A handle, pulled by a user to open the door, needs to be installed on the door frame.

However, due to a nature of a glass material, the front glass is fragile, and thus it may be difficult to form or attach the handle on or to the front glass.

In addition, when a front cover of a cabinet has a curved shape that is convex forward, a gap between the door frame and the front cover is narrow, leading to an insufficient or small installation space for the handle.

SUMMARY

In order to obviate the above-mentioned problems and other drawbacks, the present disclosure describes a laundry treating apparatus that can allow a handle to be formed on a door frame even when an installation space of the handle is small.

The present disclosure also describes a laundry treating apparatus that can improve assemblability of a handle and securely maintain a coupled state.

According to one aspect of the subject matter described in this application, a laundry treating includes a main body provided with a front cover having a laundry inlet port and a door rotatably installed on the front cover to open and close the laundry inlet port. The door may include an outer frame disposed toward an outside of the main body, a front glass provided on a front surface of the outer frame, an inner frame disposed toward an inside of the main body and coupled to a rear surface of the outer frame, and a handle that is recessed radially inward from side surfaces of the outer frame and the inner frame to form a space for putting fingers.

Implementations according to this aspect may include one or more of the following features. For example, the handle may be located higher than a radial center line that horizontally passes through centers of the outer frame and the inner frame in a radial direction.

In some implementations, the handle may include a first handle portion that is recessed radially inward and toward the front glass from the side surface of the outer frame and is configured to be open radially outward of the outer frame and toward the inner frame, and a second handle portion that is recessed radially inward from the side surface of the inner frame, is configured to be open radially outward of the inner frame and in a front-and-rear direction, and forms a space for putting the fingers together with the first handle portion.

In some implementations, the outer frame may include a flat portion that has a flat plate shape to allow the front glass to be in surface contact therewith, a mounting guide that protrudes from an outer circumferential portion of the flat portion to surround an outer surface of the front glass, and a side portion that protrudes rearward, an opposite side of the mounting guide, from the outer circumferential portion of the flat portion. The inner frame may be curved to be gradually convex rearward from an outer circumferential portion thereof that is coupled to the side portion in a contact manner to an inner side thereof in a radial direction.

In some implementations, the handle may include a first handle portion that is recessed radially inward from the side portion of the outer frame and is concave from the side portion to a rear surface of the flat portion in a thickness direction, and a second handle portion that is recessed radially inward from the outer circumferential portion of the inner frame and is formed through the outer circumferential portion of the inner frame in a front-and-rear direction so as to communicate with the first handle portion.

In some implementations, the handle may include a first handle portion that is formed on the rear surface of the outer frame so as to be caught when pulled outward of the main body by the fingers, and a second handle portion that is formed on the inner frame to communication with the first handle portion, so as to guide the fingers to the first handle portion.

In some implementations, the handle may include a first handle portion that is recessed radially inward from the side surface of the outer frame, and a second handle portion that is recessed radially inward from the side surface of the inner frame. The handle may further include, in order to allow the first handle portion and the second handle portion to be coupled to each other, a plurality of first hooks that protrudes rearward from an inner rear side of the outer frame to the inner frame, and a second hook that protrudes from an inner end of the second handle portion so as to be engaged with the plurality of first hooks.

In some implementations, a plurality of guide protrusions that protrudes between the plurality of first hooks that is spaced apart along an inner end of the first handle portion, so as to guide positions where the plurality of first hooks and the second hook are engaged may be further provided.

In some implementations, a plurality of through-holes that is formed through the outer frame in a thickness direction between the inner end of the first handle portion and the plurality of first hooks may be further provided. Each of the plurality of through-holes may overlap a hook protrusion that protrudes from one of the plurality of first hooks in the thickness direction.

In some implementations, each of the plurality of first hooks may include a hook body that protrudes rearward from the rear surface of the outer frame, and a hook protrusion that protrudes from an end of the hook body toward the second hook. The second hook may be inserted through a gap between the hook protrusion inwardly spaced apart from an inner end of the first handle potion and the inner end of the first handle potion.

In some implementations, the hook protrusion may include a first inclined surface that is inclined toward the inner end of the second handle portion from the hook body, and a first engagement surface that is vertically formed toward the inner end of the second handle portion from the hook body. The second hook may include a second inclined surface that is inclined from the inner end of the second handle portion to be in surface contact with the first inclined surface so as to elastically press the first inclined surface, and a second engagement surface that is vertically formed from the inner end of the second handle portion so as to be in surface contact with the first engagement surface.

In some implementations, each of the plurality of first hooks may further include a rib that protrudes from a rear surface of the hook body to reinforce rigidity of the hook body that is elastically deformed in a direction opposite to a protruding direction of the hook protrusion when fastened to the second hook.

In some implementations, the second handle portion may have a curved shape that is convex radially inward of the inner frame.

In some implementations, the second handle portion may be provided with a plurality of reinforcing ribs formed on an inner surface thereof in a protruding manner, so as to reinforce rigidity of the second handle portion that is elastically deformed in a direction opposite to a recessed direction thereof when coupled to the first handle portion.

In some implementations, the front cover may be curved such that a central portion thereof protrudes more than both left and right ends thereof along a center line that passes through a center of the laundry inlet port in an up-and-down direction.

In some implementations, the front cover may include a recess portion that surrounds the laundry inlet port and is recessed from a front surface of the front cover toward the inside of the main body. A portion of the door may protrude outward from the recess portion.

In some implementations, the handle may include a first handle portion that is radially recessed from the side surface of the outer frame and is spaced apart from the recess portion to the outside of the main body, and a second handle portion that is radially recessed from the side surface of the inner frame and is partially covered by the recess portion.

Effects of a laundry treating apparatus according to the present disclosure will be described as follows.

First, as a handle is recessed radially inward from a side surface of a door frame, an installation space of the handle may be achieved without installing the handle on a front surface of the door frame on which a front glass is installed.

Second, as a front cover is curved such that its central portion protrudes more than its both ends, more portions of the side surface of the door frame may be covered. Accordingly, the handle may be implemented as a pocket that is recessed radially inward from a side surface of the outer frame that protrudes outward of a main body, allowing a space for putting fingers to be acquired or secured even when a gap between an outer circumferential surface of the door frame and the front cover is narrow.

Third, as the handle is provided on the door frame, a waist bending angle that the user has to bend down to open or close the door may be minimized.

Fourth, in order to couple a first handle portion and a second handle portion to each other, a plurality of first hooks may protrude along an inner end of the first handle portion that is recessed from the outer frame, and a second hook may protrude along an inner end of the second handle portion that is recessed from an inner frame, and thus the first hooks and the second hook may be engagingly fastened to each other, allowing the first handle portion and the second handle portion to be securely coupled to each other.

Fifth, as the second hook is inserted through a gap between a hook protrusion of the first hook, which is inwardly spaced apart from an inner end of the first handle portion, and the inner end of the first handle portion, a fastening force between the first hook and the second hook may be increased.

Sixth, as a plurality of guide protrusions is formed on an end of the second handle portion and protrudes between the plurality of first hooks to guide positions where the first hooks and the second hook are engagingly coupled to each other, assemblability may be improved.

Seventh, as a plurality of through-holes is formed through the outer frame on which the plurality of first hooks is provided in a thickness direction, a mold may be easily removed after injection molding of the plurality of first hooks. In addition, as the first hook overlaps the through-hole in the thickness direction, the first hooks may be elastically deformed when the first hooks and the second hook are fastened together.

Eighth, each of the plurality of first hooks includes a hook body that protrudes from a rear surface of the outer frame and a hook protrusion that protrudes from an end of the hook body toward the second hook. The hook protrusion includes the first inclined surface that is inclined toward an inner end of the second handle portion from the hook body and a first engagement surface that vertically extends toward the inner end of the second handle portion from the hook body. The second hook includes a second inclined surface that is inclined from the inner end of the second handle portion to be in surface contact with the first inclined surface, and a second engagement surface that is vertically formed to be in surface contact with the first engagement surface. With this configuration, when the first hooks and the second hook are fastened together, the second inclined surface may be disposed at an outside of the first inclined surface to come in surface contact, allowing the first inclined surface to be elastically pressed radially inward. In addition, as the first engagement surface and the second engagement surface come in surface contact with each other in the vertical direction, a coupling force may be further increased.

Ninth, as the hook body of the first hook is configured to be elastically deformed in a direction opposite to a protruding direction of the hook protrusion, and a rib protrudes vertically from a rear surface of the hook body, rigidity of the hook body may be reinforced.

Tenth, as the second handle portion is recessed radially inward of the inner frame, the second handle portion is configured to be elastically deformed radially outward of the inner frame when coupled to the first handle portion, and a plurality of reinforcing ribs protrudes radially inward from a rear surface of the second handle portion, rigidity of the second handle portion may be reinforced.

DETAILED DESCRIPTION

Figure 1:
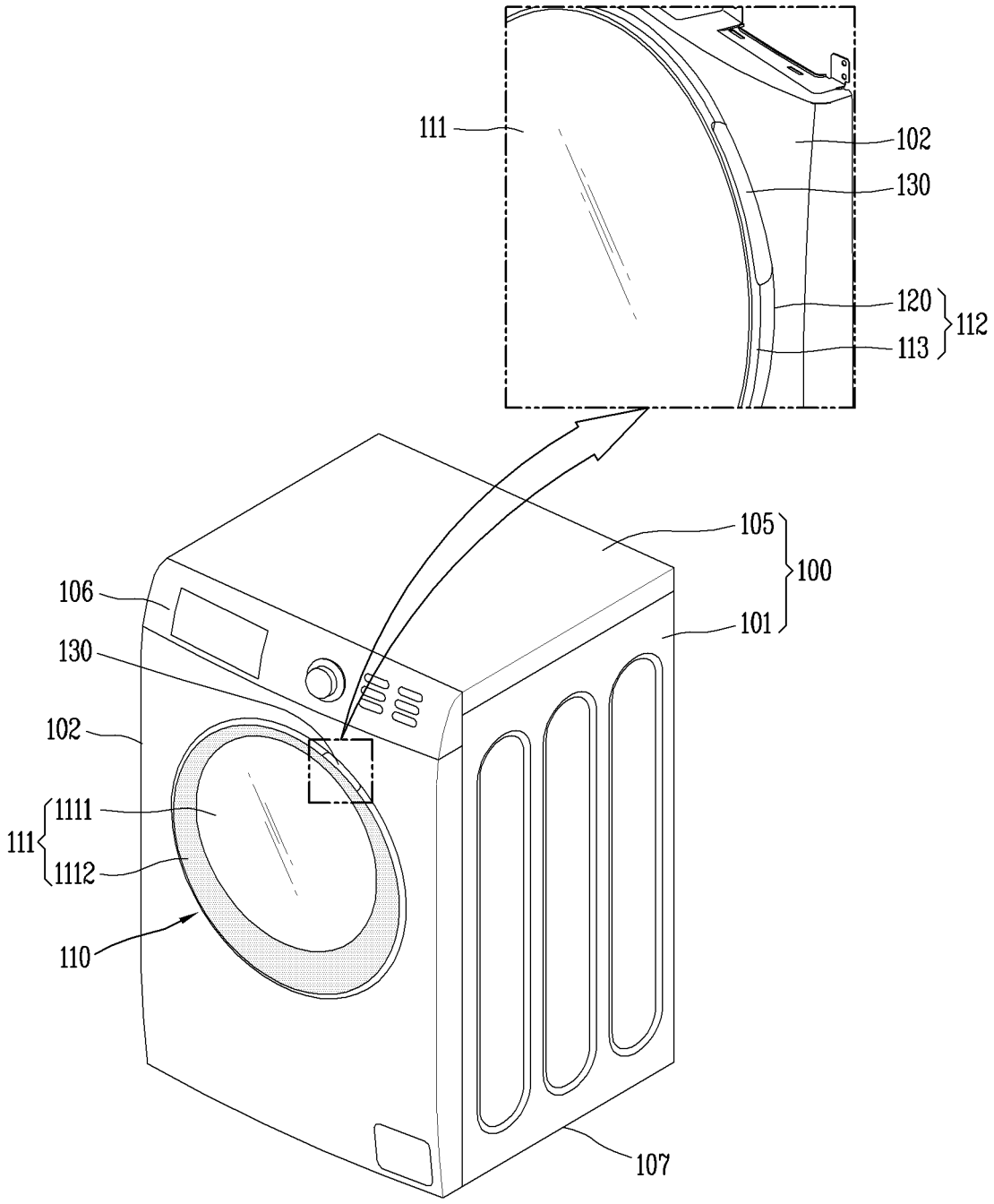
FIG. 1 is a perspective view of a laundry treating apparatus according to an implementation of the present disclosure.

Hereinafter, one or more implementations will be described with reference to the accompanying drawings. In the drawings, the same or similar elements are designated with the same or similar reference numerals, and redundant description has been omitted. The suffixes "module" and "unit" for components or elements used in the following description are given or mixed in consideration of ease in creating specification, and do not have distinct meanings or roles. In describing implementations, if a detailed explanation for a related known technology or construction is considered to unnecessarily divert the main point, such explanation has been omitted but would be understood by those skilled in the art. Also, it should be understood that the accompanying drawings are merely illustrated to easily explain the concept, and therefore, they should not be construed to limit the technological concept disclosed herein by the accompanying drawings, and the concept should be construed as being extended to all modifications, equivalents, and substitutes included in the concept and technological scope.

Terms including ordinal numbers such as first and second may be used to describe various elements, but the elements are not limited by the terms. The terms are used merely for the purpose to distinguish an element from another element.

It will be understood that when an element is referred to as being "connected with" another element, the element can be connected with the another element or intervening elements may also be present. On the contrary, in case where an element is "directly connected" or "directly linked" to another element, it should be understood that any other element is not existed therebetween.

Singular expressions include plural expressions unless the context clearly indicates otherwise.

Terms "include" or "has" used herein should be understood that they are intended to indicate the existence of a feature, a number, a step, a constituent element, a component or a combination thereof disclosed in the specification, and it may also be understood that the existence or additional possibility of one or more other features, numbers, steps, elements, components or combinations thereof are not excluded in advance.

Figure 2:
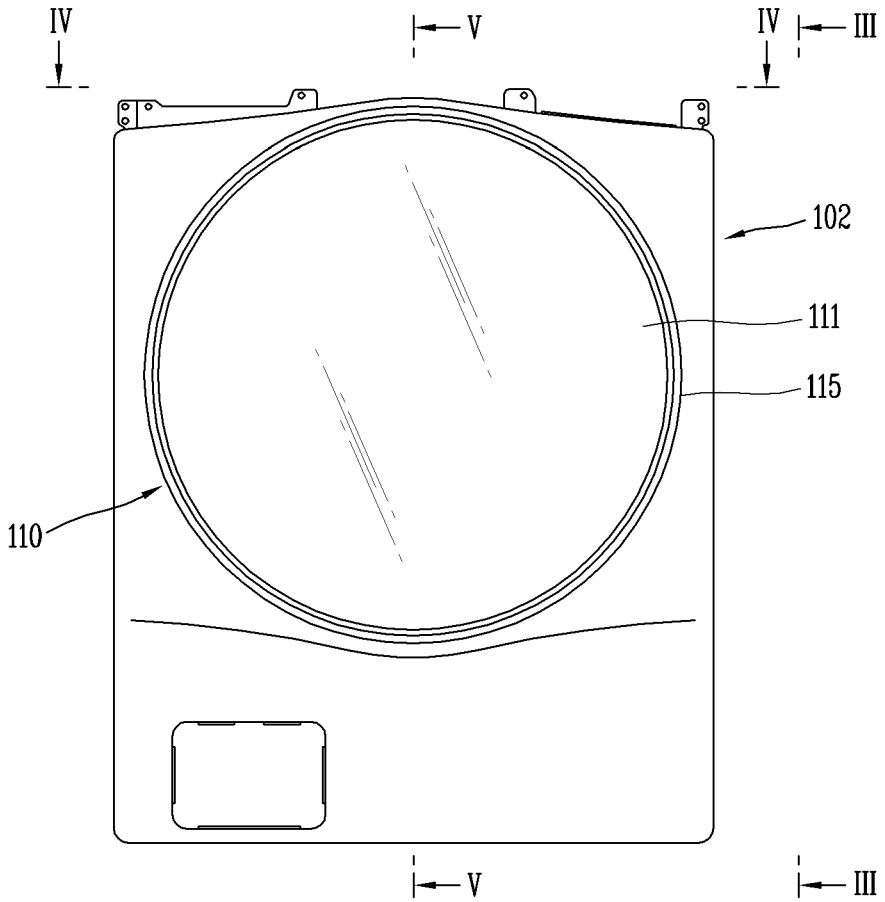
FIG. 2 is a front view of a front cover on which a circular glass door is installed, when viewed from the front of the laundry treating apparatus in FIG. 1.
Figure 3:
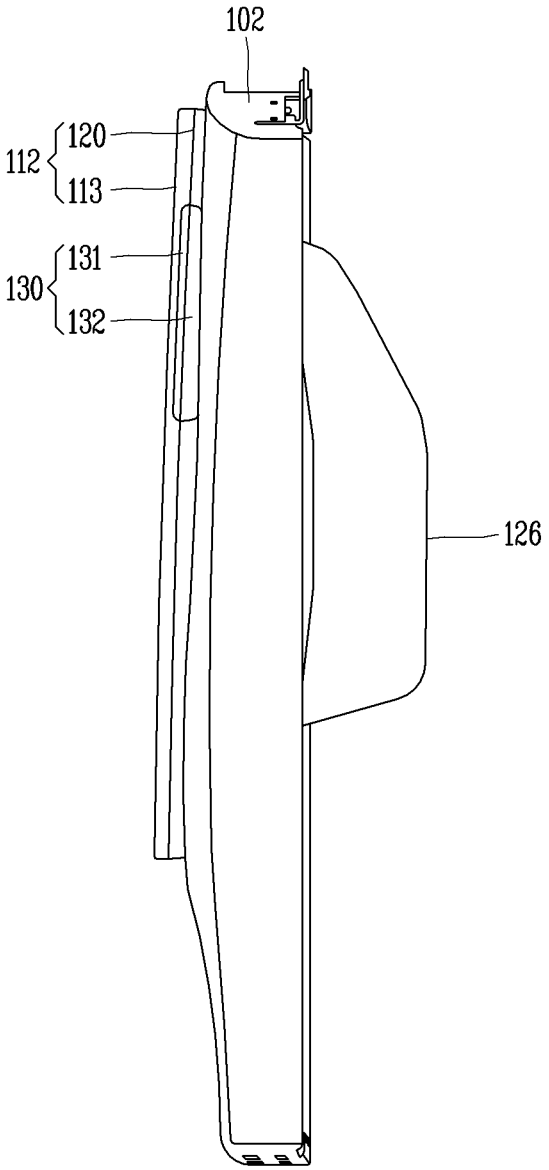
FIG. 3 is a side view taken along line "III-III" in FIG. 2.
Figure 4:
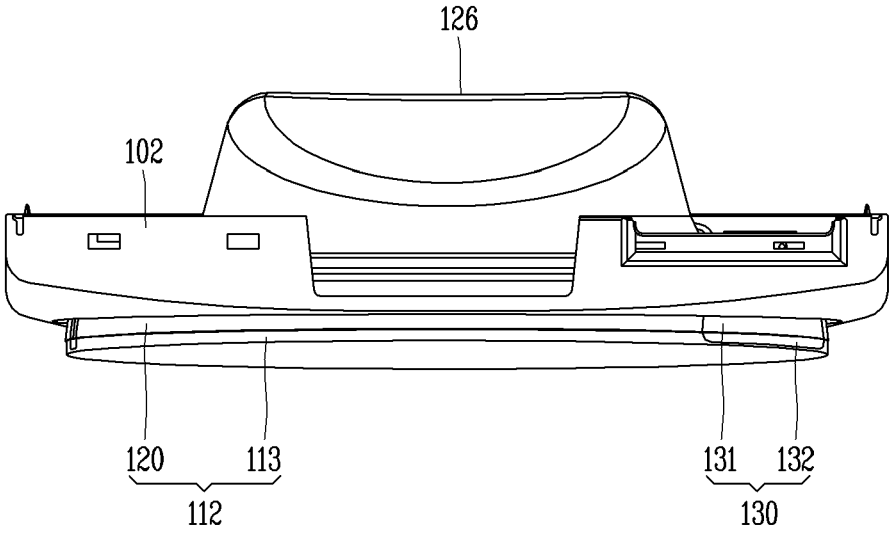
FIG. 4 is a planar view taken along line "IV-IV" in FIG. 2.
Figure 5:
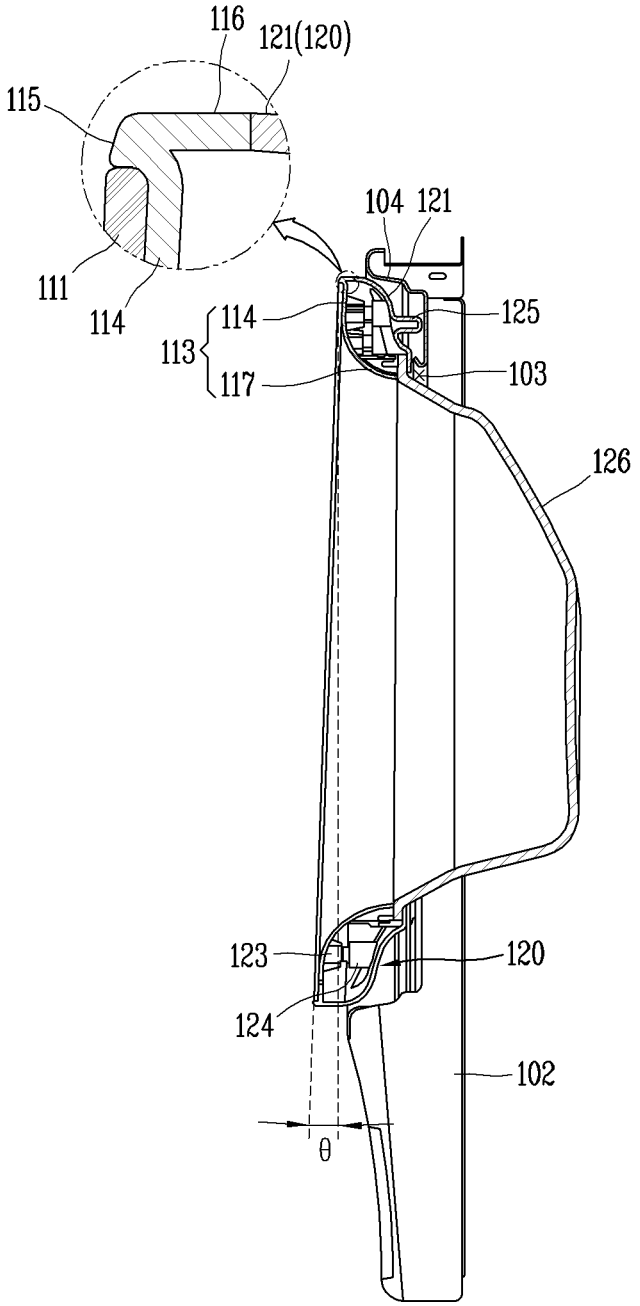
FIG. 5 is a cross-sectional view taken along line "V-V" in FIG. 2.

FIG. 1 is a perspective view of a laundry treating apparatus according to an implementation of the present disclosure;

FIG. 2 is a front view of a front cover on which a circular glass door is installed, when viewed from the front of the laundry treating apparatus in FIG. 1;

FIG. 3 is a side view taken along line "III-III" in FIG. 2;

FIG. 4 is a planar view taken along line "IV-IV" in FIG. 2;

FIG. 5 is a cross-sectional view taken along line "V-V" in FIG. 2.

The laundry treating apparatus disclosed herein may include a main body 100, a laundry accommodating portion, and a door 110.

The main body 100 may define an outer appearance and a body structure (or frame) of the laundry treating apparatus. The main body 100 may have a rectangular parallelepiped shape.

The main body 100 may include a front cover 102, a body 101, a top cover 105, and a base 107.

The front cover 102 may define a front surface of the laundry treating apparatus. The front cover 102 may have a rectangular shape when viewed from the front of the laundry treating apparatus.

The front cover 102 may include a front portion (surface), left and right portions, an upper portion, and a lower portion.

A laundry inlet port (or hole) 103 may be formed in the front portion of the front cover 102. Laundry may be put into the main body 100 through the laundry inlet port 103.

The laundry inlet port 103 may have a circular shape. A center of the laundry inlet port 103 may be located higher than a center in a height direction of the front cover 102.

The front portion of the front cover 102 may be formed as a curved surface that is convex toward the front of the laundry treating apparatus. A central part of the front portion is located forward than left and right ends thereof.

The front portion of the front cover 102 may be curved that is convex forward from its both left and right ends to its central part.

Each of the left and right portions of the front cover 102 is formed as a flat surface. Each of the left and right portions extends rearward, namely, toward the body 101 from the left and right ends of the front portion. The left and right portions of the front cover 102 are coupled to front left and right ends of the body 101, respectively.

Each of the upper and lower portions of the front cover 102 is formed as a flat surface. Each of the upper and lower portions extends rearward, namely, toward the body 101 from upper and lower ends of the front portion.

The upper portion of the front cover 102 may be coupled to a control panel 106 disposed on the front cover 102.

The lower portion of the front cover 102 may be coupled to a front end of the base 107.

The body 101 may include a plurality of side portions and a rear portion connecting the rear ends of each of the plurality of side portions. A front portion of the body 101 is open. The front cover 102 and the control panel 106 are configured to cover an opening formed in the front portion of the body 101.

The side portions of the body 101 that define left and right side surfaces of the laundry treating apparatus, respectively, and the rear portion of the body 101 that defines a rear surface of the laundry treating apparatus are formed as one body. Accordingly, structural rigidity of the body 101 may be improved, allowing the body 101 to withstand loads without failure.

A recess (or recessed) portion 104 may be provided in the front cover 102 to be recessed toward an inside of the main body 100, so as to surround the laundry inlet port 103. The laundry inlet port 103 is formed through an inside of the recess portion 104. A part or portion of the door 110 may be accommodated in the recess portion 104.

The door 110 may be rotatably coupled to the front cover 102 by a hinge 141, so as to open and close the laundry inlet port 103.

The laundry accommodating portion may be provided in the main body 100. The laundry accommodating portion may include a tub and a drum.

The laundry accommodating portion may include a drum to perform a drying function, or a tub and a drum to perform washing and drying functions together.

The tub may have a cylindrical shape, and be disposed such that its central axis is horizontal or at a predetermined angle in a lengthwise direction of the tub. Wash water may be stored in the tub.

The drum may be provided in the tub to be rotatable with respect to the tub.

A gasket may be provided at a front end of the tub to communicate with the laundry inlet port 103, thereby preventing wash water stored in the tub from leaking into an accommodation space of the main body 100.

A front portion of the drum may be open and in communication with the laundry inlet port 103. Laundry may be introduced into the drum through the laundry inlet port 103.

A drive motor may be installed at a rear surface of the tub. The drive motor may be connected to a rear surface of the drum by a rotating (or rotational) shaft.

As the drive motor is driven, power of the drive motor may be transmitted to the drum through the rotating shaft, allowing the drum to be rotated.

A plurality of communication holes may be formed through a circumferential surface of the drum to allow a fluid, such as wash water, to flow into and out of the drum through the plurality of communication holes.

The drum may be provided therein with a plurality of lifters to rotate laundry accommodated in the drum, thereby performing washing and drying functions.

The control panel 106 may be provided on the main body 100 or the door 110. In the depicted example, the control panel 106 is located on an upper portion of the front panel 102 of the main body 100.

The control panel 106 is configured to display information related to operations of the laundry treating apparatus to a user and to receive the user's input.

The control panel 106 may include a circular knob and a plurality of buttons for receiving the user's input, for example.

The control panel 106 may also include a display that displays visual information.

Figure 6:
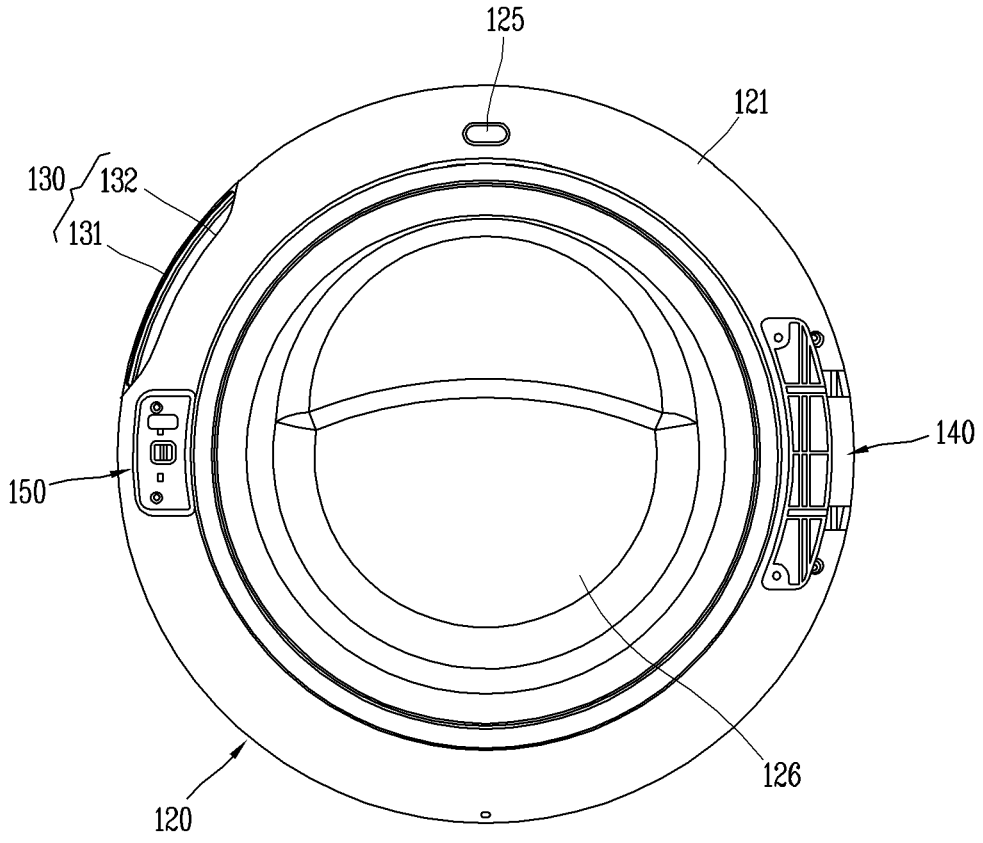
FIG. 6 is a rear view of a door assembly in FIG. 5.

FIG. 6 is a rear view of a door assembly in FIG. 5.

Figure 7:
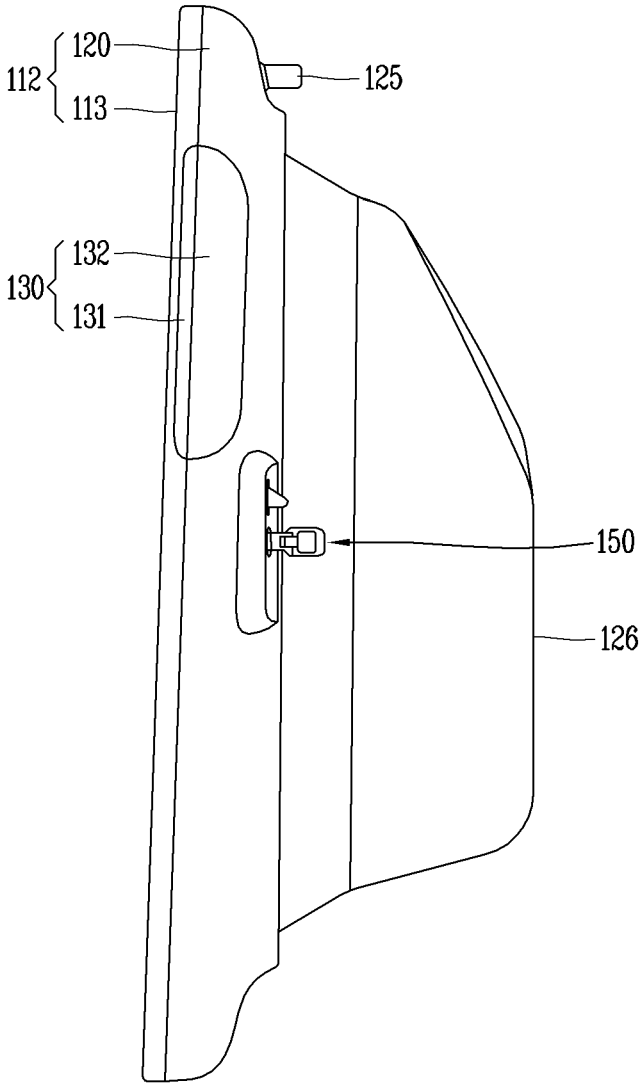
FIG. 7 is a side view of the door assembly in FIG. 6.

FIG. 7 is a side view of the door assembly in FIG. 6.

Figure 8:
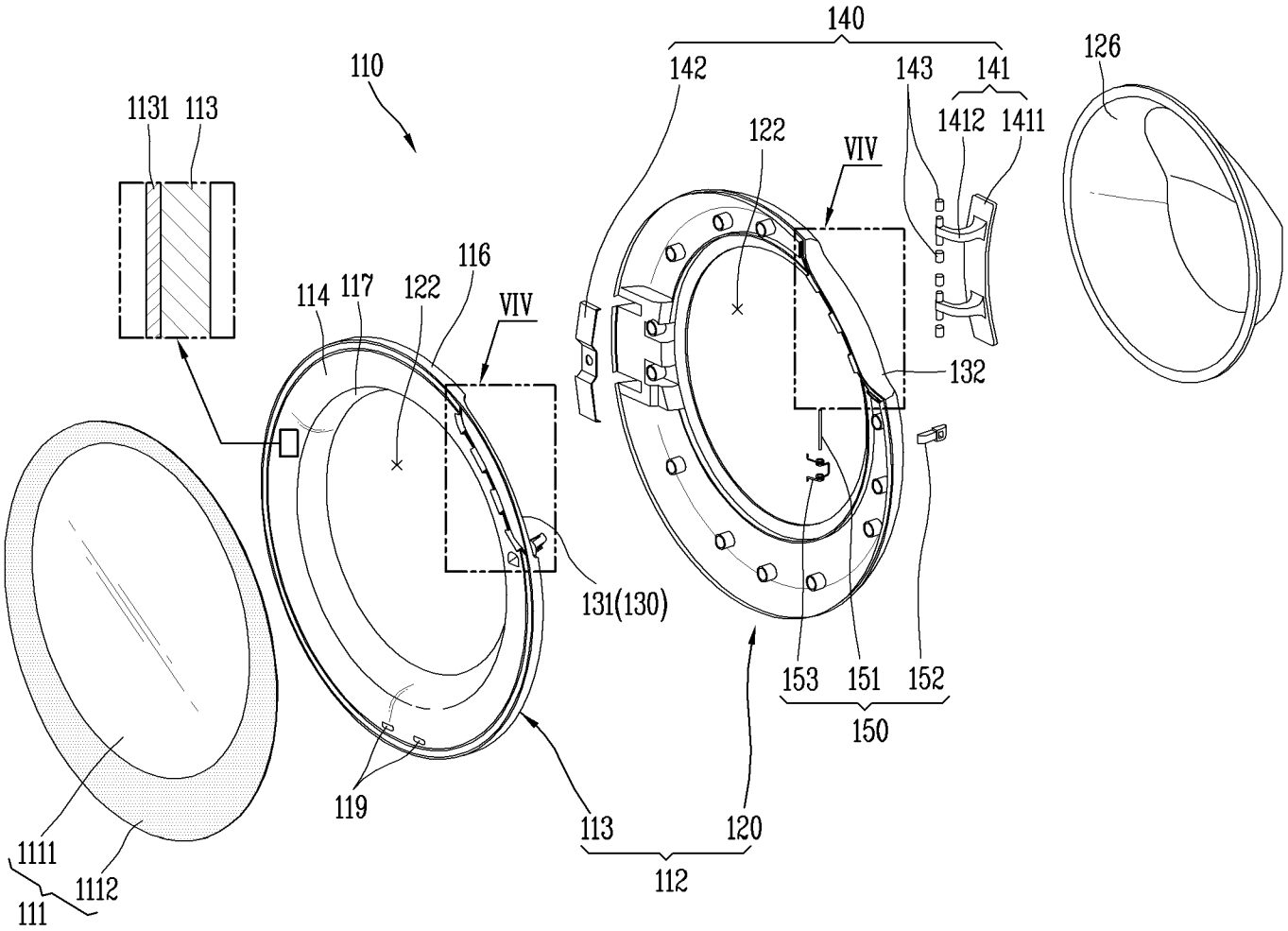
FIG. 8 is an exploded view of the door assembly in FIG. 5.

FIG. 8 is an exploded view of the door assembly in FIG. 5.

The door 110 may include a door frame 112, a front glass 111, a door window 126, a hinge unit 140, and a locking unit 150.

The door frame 112 may have a ring shape.

The door frame 112 may include an outer frame 113 and an inner frame 120.

The outer frame 113 and the inner frame 120 may be made of a synthetic resin material such as an acrylonitrile butadiene styrene (ABS) material and a polycarbonate (PC) material. Each of the outer frame 113 and the inner frame 120 may be manufactured by injection molding, for example, when made of a synthetic resin material.

The outer frame 113 and the inner frame 120 may each have a ring shape, and may be coupled to each other in an overlapping manner in a forward-rearward (or back-and-forth) direction. A coupling protrusion 123 may protrude from a rear surface of the outer frame 113. A protrusion accommodating portion 124 may be provided on a front surface of the inner frame 120 in a protruding manner, so as to accommodate the coupling protrusion 123.

The protrusion accommodating portion 124 may be provided therein with an accommodation groove, and the accommodation groove may have the same shape as the coupling protrusion 123. As the coupling protrusion 123 is inserted into the protrusion accommodating portion 124, they may be fitted to each other.

The outer frame 113 and the inner frame 120 are named as such as the outer frame 113 is disposed toward or faces an outside of the main body 100 and the inner frame 19 is disposed toward or faces an inside of the main body 100 based on a state in which the door 110 is closed. The outer frame 113 may be referred to as a "first frame", and the inner frame 120 may be referred to as a "second frame"

A circular opening 122 may be formed in the outer frame 113 and the inner frame 120 in a corresponding manner.

The openings 122 may be eccentrically positioned from centers of the outer frame 113 and the inner frame 120, respectively. For example, centers of the openings 122 may be located above the centers of the outer frame 113 and the inner frame 120, respectively.

With this configuration, each of the outer frame 113 and the inner frame 120 may vary in width along a circumferential direction. In other words, a distance (width) between an outer diameter and an inner diameter (diameter of the opening 122) of each of the outer frame 113 and the inner frame 120 may increase (widen) from a top end to a bottom end.

A center of the drum may be located higher than a center of a height (½) of the main body 100.

Consumers tend to prefer a larger size of the door 110 with respect to a same capacity and size of washing machine when looking at the main body 100 from the front.

In addition, consumers are able to look into the drum through the door 110, and if possible, prefer a wide field of view with regard to an inner space of the drum.

In order to satisfy the needs of consumers, the door 110 must be enlarged downward to increase the size of the door 110 while a position of the drum is fixed.

A center of the door frame 112 must move below a center of the laundry inlet port 103 or the opening 122. Similarly, the center of the door frame 112 may move downward with respect to the door window 126 positioned to correspond to the opening 122.

In addition, in order to increase the size of the door 110, a portion of the door may protrude outward from the recess portion 104. A diameter of the door 110 may be greater (or larger) than a diameter of the recess potion 104.

The front glass 111 may be installed on a front surface of the outer frame 113 so as to allow the user to look into the main body 100.

The front glass 111 has a circular shape with a predetermined radius. The front glass 111 is made of a glass material.

The front glass 111 has flat front and rear surfaces.

The front glass 111 is formed in a disc shape having a constant thickness, without bending, when viewed from any direction, up, down, left, or right.

As the front and rear surfaces of the front glass 111 made of a glass material is formed flat in the circular shape, a quality grade of the door 110 may be enhanced, compared to a door cover in the related art made of a synthetic resin material.

The front glass 111 may cover the opening 122 of the door frame 112. The front glass 111 may be bonded to the front surface of the outer frame 113 by a sealant or an adhesive, for example.

Due to a nature of the glass material, the front glass 111 may be easily broken when a coupling hole is drilled in the front glass 111. Thus, the front glass 111 may be attached to the outer frame 113 using an adhesive, for example, to prevent the glass from being broken.

On the other hand, the front glass 111 made of a glass material occupies a relatively large load compared to a total load of the door 110. In order to support the load of the front glass 111, a mounting guide 115 for mounting the front glass 111 is provided on the front surface of the outer frame 113.

In particular, the front glass 111 may be made of tempered glass. Due to a nature of the tempered glass, front and rear surfaces of the front glass 111 have a high strength, but a circular outer circumferential surface, which is a side surface of the front glass 111, has a low strength.

To compensate for this, the mounting guide 115 may protrude forward from a front outer circumferential end of the outer frame 113 to surround the outer circumferential surface of the front glass 111, so as to support the load of the front glass 111 as well as to protect the side or outer circumferential surface of the front glass 111 from an external impact or shock.

A protruding length of the mounting guide 115 may cover at least ⅔ of the thickness of the front glass 111.

This is because an external impact may be applied to the outer circumferential surface of the front glass 111 and the load of the front glass 111 may not be sufficiently supported when the protruding length of the mounting guide 115 is too short.

The mounting guide 115 protrudes in a circular ring shape so as to allow the front glass 111 to be accommodated therein.

An inner diameter of the mounting guide 115 may correspond to an outer diameter of the front glass 111, so as to surround the outer circumferential surface of the front glass 111.

The mounting guide 115 may protrude by a predetermined thickness so as to define the same plane as the front surface of the front glass 111. This may allow a step between the mounting guide 115 and the front glass 111 to be eliminated, thereby achieving a simpler appearance.

A transparent region 1111 and a non-transparent region 1112 may be disposed at inner and outer sides of the front glass 111, respectively.

The transparent region 1111 denotes a region configured to transmit at least part of light so that an opposite side or the inside of the laundry accommodating portion may be viewed by the user. Therefore, the transparent region 1111 may include a translucent region.

The transparent region 1111 may correspond to the opening 122 of the outer frame 113, the opening 122 of the inner frame 120, and the door window 126. Therefore, when the door 110 is closed, the user may look into the laundry accommodating portion through the transparent region 1111.

A center of the transparent region 1111 is located at a position corresponding to a center of the opening 122 of each of the outer frame 113 and the inner frame 120. The corresponding position may include not only perfect alignment of the center, but also alignment in an eccentric direction of the center. In other words, the center of the transparent region 1111 and the center of the opening 122 may coincide, or the eccentric direction of the transparent region 1111 may be the same as the eccentric direction of the opening 122.

The non-transparent region 1112 may surround the transparent region 1111. Also, the non-transparent region 1112 does not transmit light therethrough, and thus the glass itself may appear black in the non-transparent region 18.

The non-transparent region 1112 may cover the remaining portion except for the opening 122 and a portion of the door frame 112.

A boundary line between the transparent region 1111 and the non-transparent region 1112 surrounding the transparent region 1111 may be distinguished by the non-transparent region 1112.

Alternatively, the boundary between the transparent region 1111 and the non-transparent region 1112 may be blurred through a halftone technique, thereby allowing a visual transition from the transparent region 1111 to the non-transparent region 1112. The non-transparent region 1112 may include a plurality of shielding dots arranged around the transparent region 1111, and the plurality of shielding dots may be arranged to have a lower density toward the transparent region 1111.

The outer frame 113 may include a side portion 116 (see FIG. 9), a flat portion 114, and a first curved portion 117.

The side portion 116 defines a side or lateral surface of the outer frame 113. The side portion 116 may extend rearward, namely, toward an outer circumferential end of the inner frame 120 from the mounting guide 115.

A rear end of the side portion 116 may overlap the outer circumferential end of the inner frame 120 in a thickness direction so as to cover a portion thereof. A concave portion (or groove) 127 (see FIG. 9) may be formed on the outer circumferential end of the inner frame 120. The side portion 116 may cover the concave portion 127 of the inner frame 120.

The side portion 116 and the concave portion 127 may be fitted to each other.

The flat portion 114 may be in contact with the rear surface of the front glass 111, and the flat portion 114 may partially overlap the non-transparent region 1112. An adhesive may be applied to the flat portion 114, so as to allow the front glass 111 to be adhered or attached to the flat portion 114.

An adhesive groove 1181 may be formed in a front surface of the flat portion 114 in a manner of extending in a circumferential direction, so that an adhesive may be filled therein.

An adhesive may be filled in the adhesive groove 1181, and the rear surface of the front glass 111 may be adhered to the flat portion 114 by the adhesive.

The adhesive may overflow to an outside or an inside of the adhesive groove 1181 when the adhesive groove 1181 is filled in the adhesive groove 1181. In order to accommodate the adhesive overflowing from the adhesive groove 1181, adhesive overflow grooves 1182 with a ring shape may be formed on the inside and outside of the adhesive groove 1181, respectively.

The non-transparent region 1112 of the front glass 111 may cover the adhesive groove 1181 of the flat portion 114 and the adhesive overflow grooves 1182.

A plurality of drain holes 119 may be formed through a lower side of the flat portion 114 in a thickness direction thereof. Accordingly, water or moisture (liquid) generated between the rear surface of the front glass 111 and the front surface of the outer frame 113 may be discharged to an outside of the door 110 through the plurality of drain holes 119.

The first curved portion 117 may be curved in an arcuate shape having a predetermined curvature toward an outer circumference of the opening 122 of the inner frame 120 from an inner end of the flat portion 114. An inner portion of the flat portion 114 and the first curved portion 117 may overlap an outer edge of the transparent region 1111. The opening 22 may be located at an inner side of the first curved portion 117 in a radial direction.

A plurality of circumferential ribs 1391 protruding rearward may be provided on a rear surface of the first curved potion 117. Each of the plurality of circumferential ribs 1391 may extend in a circumferential direction of the outer frame 113. The plurality of circumferential ribs 1391 may be spaced apart from one another in the circumferential direction.

A plurality of radial ribs 1392 protruding rearward may be provided on the rear surface of the first curved portion 117. Each of the plurality of radial ribs 1392 may extend in a radial direction of the outer frame 113. Each of the plurality of radial ribs 1392 may extend from an inner surface of one of the circumferential ribs 1391 to the opening 122 of the outer frame 113.

With this configuration, the plurality of circumferential ribs 1391 and the plurality of radial ribs 1392 may reinforce strength of the outer frame 113, more precisely, the first curved portion 117.

The plurality of circumferential ribs 1391 may be radially spaced apart from a first hook 133 provided at a rear surface of the flat portion 114.

A plating layer 1131 may be formed on front and outer circumferential surfaces of the outer frame 113 by chromium (or chrome) plating, for example. The outer frame 113 may be completely immersed in a chromium plating solution, flowed by the chromium plating, so that the plating layer 17 may be formed on an entire surface of the outer frame 113.

The plating layer 1131 may coat the outer frame 113 with a silver polished metal color. Accordingly, the plating layer 1131 may obtain an effect that it looks like bright silver circular droplets. In addition, the plating layer 1131 may give a luxurious feel when viewed with the naked eye.

A second curve portion 121 may be formed on a rear surface of the inner frame 120. The second curved portion 121 of the inner frame 120 may be formed as a curved surface that is convex toward the recess portion 104.

The second curved portion 121 of the outer frame 113 may be convex toward an outside of the recess portion 104, and the second curved portion 121 of the inner frame 120 may be convex toward an inside of the recess portion 104.

The door window 126 may correspond to the laundry inlet port 103 when the door 110 is closed. The door window 126 may be mounted to the door frame 112 to correspond to the opening 122 of the inner frame 120.

The door window 126 may be made of a transparent material, for example, a synthetic resin material having a light transmitting property, so that an inner space of the laundry accommodating portion, such as the drum, may be viewed through the door window 126. The door window 126 may not be necessarily limited to such synthetic material but may alternatively be made of a glass material.

An outer edge portion (or edge) of the door window 126 may be inserted and coupled between an inner end of the first curved portion 117 and an inner end of the inner frame 120.

Portions of the outer frame 113 and the inner frame 120 may protrude forward from the recess portion 104 when the door 110 is closed, and other portions of the outer frame 113 and the inner frame 120 may be accommodated in the recess portion 104.

The flat portion 114 of the outer frame 113 may be disposed at the outside of the recess portion 104 and protrude forward from the recess portion 104. A rear end of the first curved portion 117 of the outer frame 113 may be accommodated in the recess portion 104.

An outer circumference of the inner frame 120 may protrude outward from the recess portion 104, and an inner circumference of the inner frame 120 may be accommodated in the recess portion 104.

The door frame 112 may be inclined at a predetermined angle with respect to a vertical surface of the recess portion 104. A lower end of the door frame 112 may be located forward than an upper end of the door frame 112.

The hinge unit 140 may allow the door 110 to be rotated in the back-and-forth direction with respect to the main body 100.

The hinge unit 140 may include the hinge 141, a hinge holder 142, and a bush 143.

The hinge 141 may be fixed to the main body 100 and be rotatably coupled to the door frame 112. The hinge 141 may include a plate-shaped base portion 1411 that is coupled to the main body 100, and a rotation coupling portion 1412 that protrudes from the base portion 1411 and is rotatably coupled to the door frame 112. A plurality of rotation coupling portions 1412 may be spaced apart in an up-and-down direction.

The hinge holder 142 may be coupled to the door frame 112 to support the plurality of rotation coupling portions 1412 and to prevent the plurality of rotation coupling portions 1412 from being released from the door frame 112.

The bush 143 may be inserted into a rotating shaft of each rotation coupling portion 1412 to smoothly rotate the rotating shafts.

The hinge unit 140 may be mounted at one side of the door 110, and the locking unit 150 may be provided at another side of the door 110. The locking unit 150 may be configured to lock or unlock the door 110 to or from the main body 100.

The locking unit 150 may include a shaft 151, a door latch 152, and a spring 153.

The shaft 151 may pass through the door latch 152, and be mounted on the door frame 112. The spring 153 has an elastic force to be retractable during rotation of the door latch 152.

Accordingly, the door latch 152 may be configured to be rotatable and restorable (or resilient) with respect to the door frame 112 so as to lock or unlock the door 110 to or from the main body 100.

The door frame 112 may be spaced apart from the recess portion 104 in a forward direction.

Meanwhile, when the drum with full of laundry is rotated during a washing cycle or process, impact may be applied to a lower rear side of the door window 126 due to a collision between a rear surface of the door window 126 and the laundry.

The lower end of the door frame 112 may be shaken in a direction of being spaced apart from the recess portion in the forward direction due to the impact, and the upper end of the door frame 112 may move toward the recess portion 104 to thereby collide with a starting point where the recess portion 104 is recessed.

Each time impact is applied to the door frame 112 while the door frame 112 and the recess portion 104 are spaced apart from each other, contact and separation of the door frame 112 and the recess portion 104 are repeated, causing vibration and noise.

In order to minimize such vibration and noise, a protruding portion 125 that protrudes toward the recess portion 104 from an upper rear side of the inner frame 120 accommodated in the recess portion 104.

With this configuration, even when impact is applied to the lower end of the door frame 112 in a state that the door 110 is closed, the protruding portion 125 may not be separated or spaced apart from the recess portion 104, allowing the protruding portion 125 to be in contact with the recess portion 104 at all times. This may result in minimizing impact as well as reducing vibration and noise.

In addition, as the door frame 112 is inclined such that its upper end is located closer to the recess portion 104 compared to its lower end, allowing the protruding portion 125 to be in contact with the recess portion 104 without being spaced apart therefrom.

As described above, the front cover 102 may be curved such that its central portion protrudes more than its left and right ends along a center line that passes through a center of the front cover 102 (front portion) in the up-and-down direction.

The handle 130 may be provided at an upper portion of the door frame 112 to allow the user to easily pull the door 110. The upper portion of the door frame 112 refers to an upper part of a radial center line that passes through a center of the door frame 112 in a horizontal radial direction parallel to the ground.

This is because when the handle 130 is provided at a lower portion of the door frame 112, the user has to bend down more.

When the front cover 102 has a curved shape, and the upper end of the door frame 112 is located closer to the recess portion 104 than that of the lower end of the door frame 112, an area for installing or forming the handle 130 on the door frame 112 is insufficient.

Figure 9:
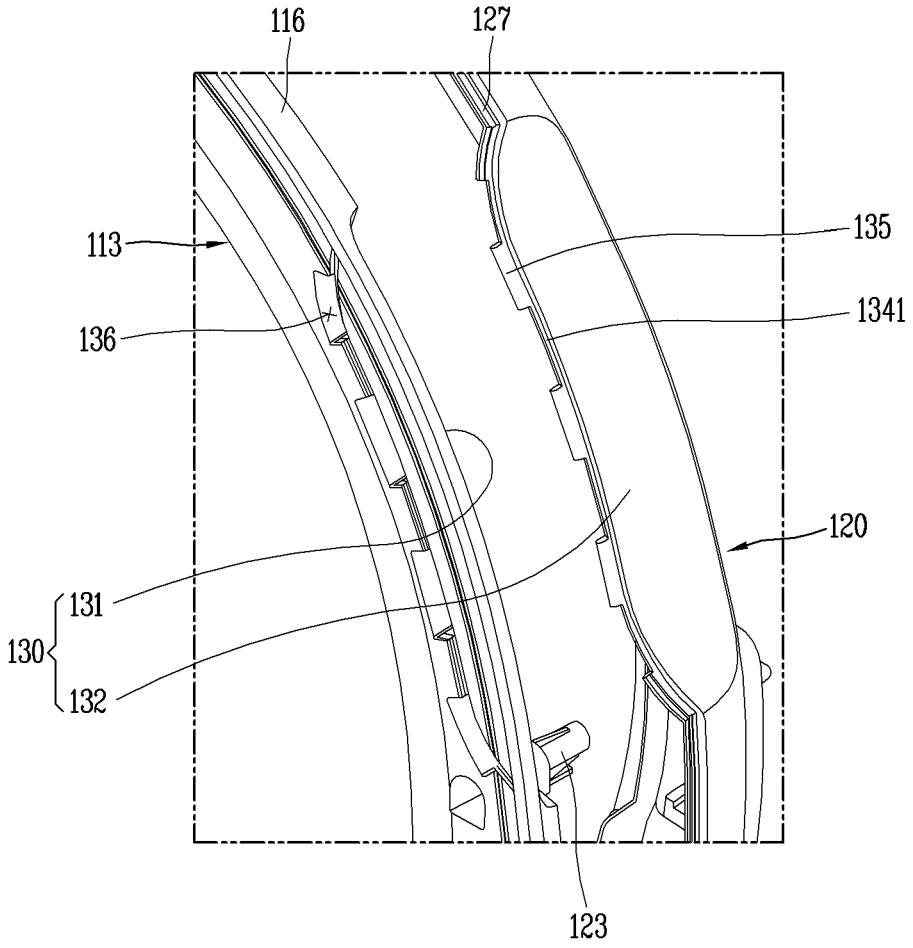
FIG. 9 is an enlarged view of a portion "VIV" in FIG. 8 for illustrating a state in which a first handle portion and a second handle portion are separated from each other.

FIG. 9 is an enlarged view of a portion "VIV" in FIG. 8 for illustrating a state in which a first handle portion and a second handle portion are separated from each other.

Figure 10:
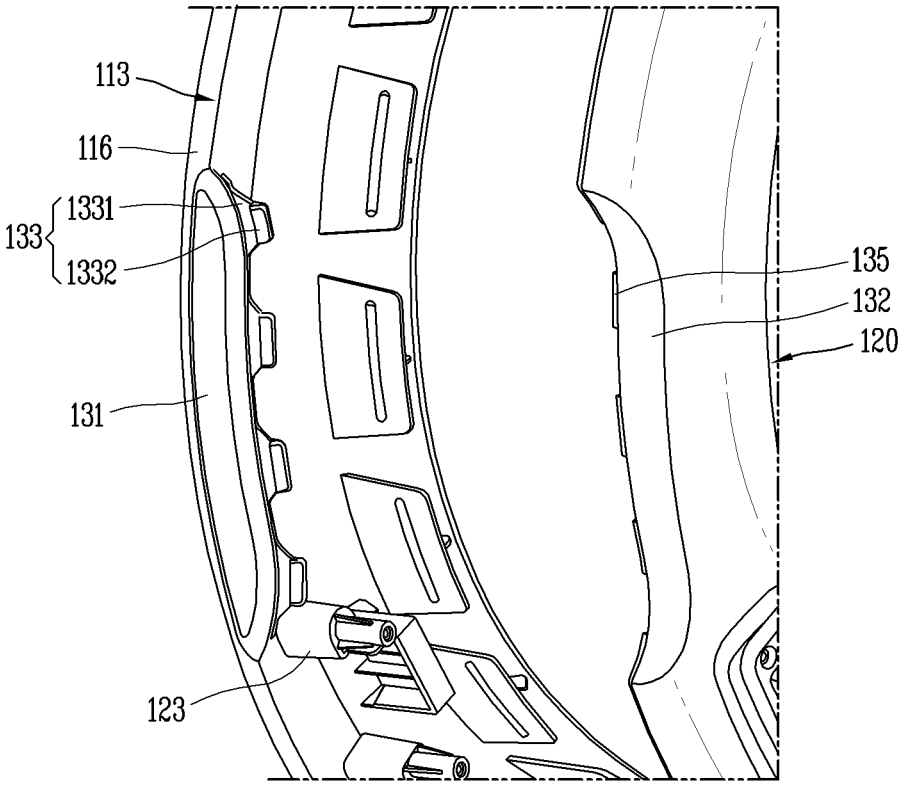
FIG. 10 is a rear view of the first handle portion and the second handle portion of FIG. 9.

FIG. 10 is a rear view of the first handle portion and the second handle portion of FIG. 9.

Figure 11:
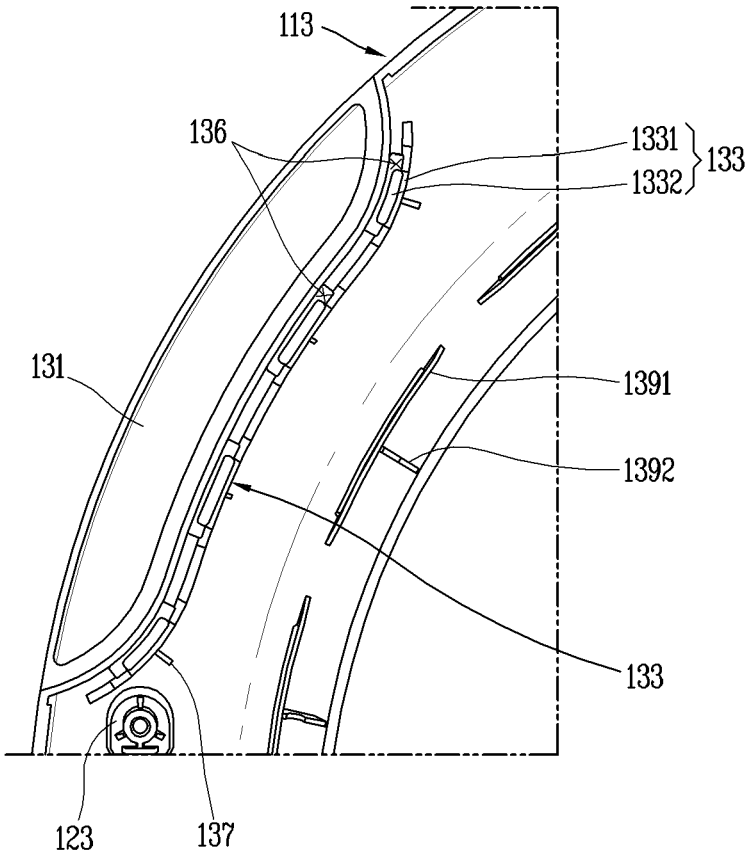
FIG. 11 is a rear view of a through-hole formed between an inner end of the first handle portion and a first hook in FIG. 10.

FIG. 11 is a rear view of a through-hole formed between an inner end of the first handle portion and a first hook in FIG. 10.

Figure 12:
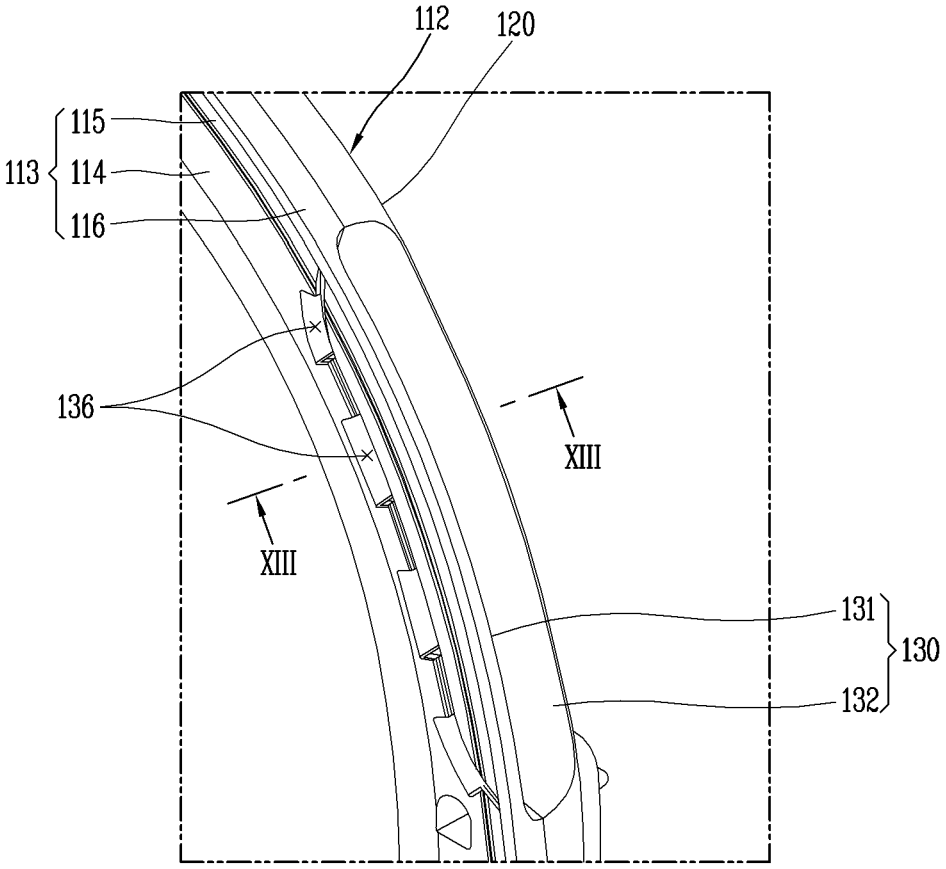
FIG. 12 is an enlarged view illustrating a coupled state between the first handle portion and the second handle portion of FIG. 9.

FIG. 12 is an enlarged view illustrating a coupled state between the first handle portion and the second handle portion of FIG. 9.

Figure 13:
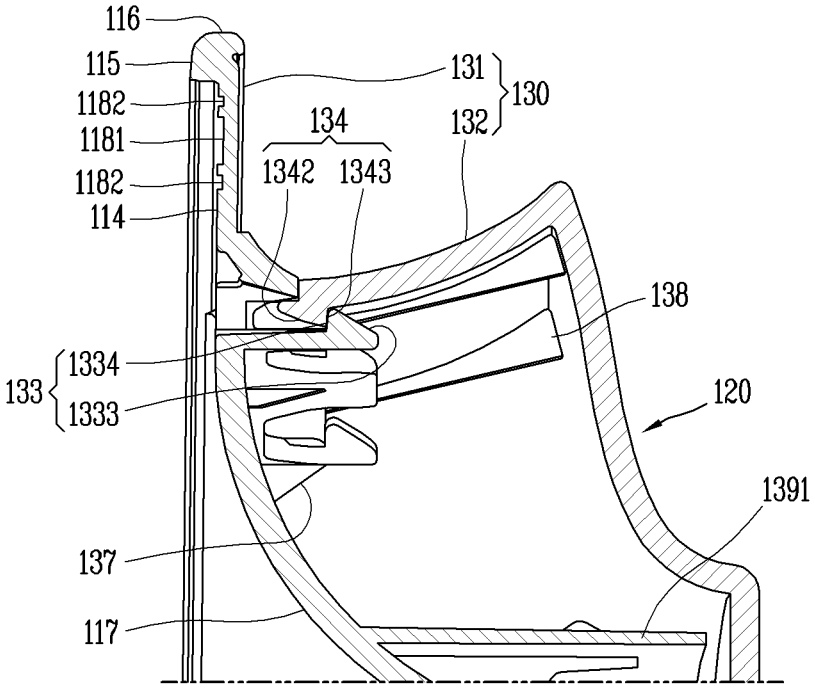
FIG. 13 is a cross-sectional view illustrating a hook fastening structure between the first handle portion and the second handle, taken along line "XIII-XIII" in FIG. 12.

FIG. 13 is a cross-sectional view illustrating a hook fastening structure between the first handle portion and the second handle, taken along line "XIII-XIII" in FIG. 12.

Figure 14:
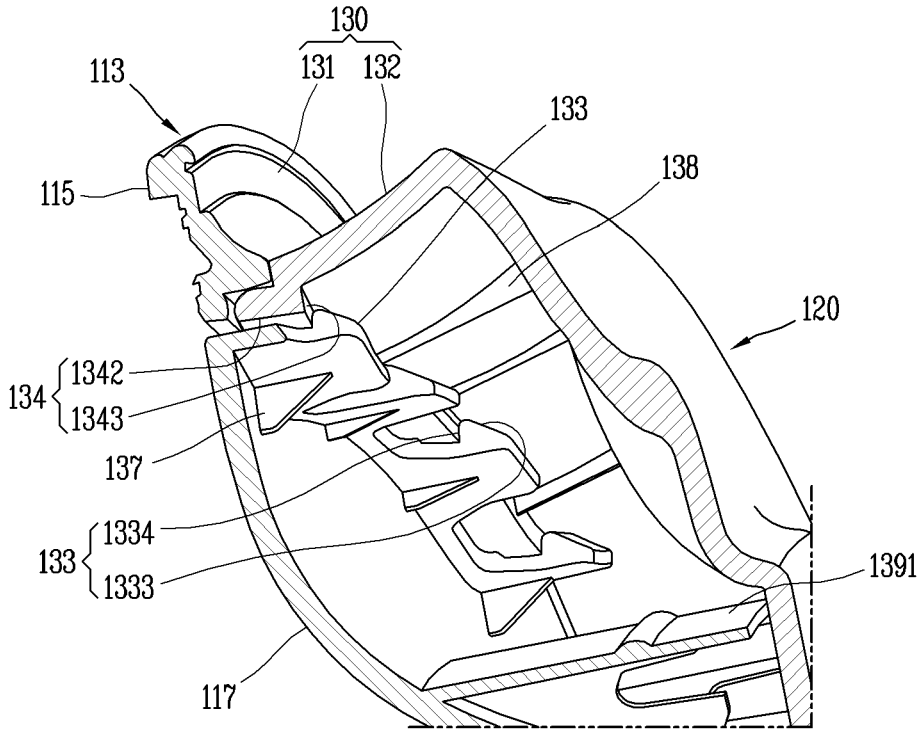
FIG. 14 is a schematic view of a hook fastening structure in FIG. 13, viewed from the bottom.

FIG. 14 is a schematic view of a hook fastening structure in FIG. 13, viewed from the bottom.

The handle 130 may be provided at a side surface of the door frame 112 for acquiring a sufficient installation area when installing the handle 130 on the door frame 112.

The reasons are as follows. First, due to the curved shape of the front cover 102, the upper portion of the door frame 112 is partially accommodated in the recess portion 104 of the front cover 102, and thus a space between the door frame 112 and the front cover 102 is not enough for the user to put his or her hand.

Second, a front surface of the door frame 112 is covered by the front glass 111, making it difficult to install the handle 130.

The handle 130 may be provided on a side surface of the outer frame 113 that protrudes outward of the recess portion 104 and a side surface of the inner frame 120.

Since the handle 130 requires no additional component (part), the handle 130 may be integrally formed with the door frame 112.

The handle 130 and the door frame 112 may be formed by injection molding using synthetic resin. This may result in increasing productivity.

The handle 130 may be recessed radially inward from the side surface of the door frame 112, so as to allow the user to put his or her fingers (e.g., an index finger, a middle finger, a ring finger, and a little finger).

The handle 130 may be implemented as a pocket on the side surface of the door frame 112. The handle 130 may be configured to be open radially outward from the side surface of the door frame 112.

The handle 130 may include a first handle portion 131 and a second handle portion 132.

The first handle portion 131 may be formed on the side surface of the outer frame 113.

The second handle portion 132 may be formed on the side surface of the inner frame 120.

The first handle portion 131 may be disposed at the front of the second handle portion 132.

As the first handle portion 131 and the second handle portion 132 are disposed to face each other in the back-and-forth direction, one pocket in which fingers of the user are put may be achieved.

The first handle portion 131 may be configured to be open toward the second handle portion 132 from the rear surface of the outer frame 113. Also, the first handle portion 131 may be configured to be open rearward, namely, toward the recess portion 104.

The second handle portion 132 may be open forward, namely, toward the first handle portion 131.

As the first handle portion 131 is recessed radially inward from the side portion 116 of the outer frame 113 and is concave toward the flat portion 114 from the rear surface of the outer frame 113, which is an opposite side of the flat portion 114, a space for putting fingers radially inward from the side surface of the outer frame 113 may be acquired.

As the second handle portion 132 is recessed radially inward from a side surface of an outer circumferential portion of the inner frame 120, a space for putting fingers radially inward from the side surface of the inner frame 120 may be acquired.

An inner radial end of the first handle portion 131 may have a round shape.

An inner surface of the first handle portion 131 may be recessed radially inward than the side portion 116 of the outer frame 113.

An inner surface of the second handle portion 132 may correspond to the inner surface of the first handle portion 131.

The first handle portion 131 may protrude outward of the recess portion 104.

A part of the second handle portion 132 may protrude outward of the recess portion 104, and another part of the second handle portion 132 may be accommodated in the recess portion 104.

A front part of the first handle portion 131, which is a rear side of the flat portion 114 of the outer frame 113, may be open radially outward of the door frame 112 so as to be exposed to the outside. The front part of the first handle portion 131 may be pulled by being in contact with fingertips of the user.

A pad of the handle 130, made of rubber, is attached to the first handle portion 131 to cover the front surface of the first handle portion 131, thereby preventing fingers from slipping off the handle 130 when pulled. The pad of the handle 130 may minimize a sense of foreign body (or discomfort) and give the user a soft feeling when touched.

The first handle portion 131 not only serves to provide a space for putting a hand of the user, but also to receive force pulled by the hand of the user.

The second handle portion 132 not only serves to provide a space for putting the hand of the user, but also to guide movement of fingers of the user to the first handle portion 131.

The handle 130 includes a plurality of hooks to securely couple two components together, namely, the first handle portion 131 and the second handle portion 132.

The handle 130 includes the first hook 133 and a second hook 134.

The first hook 133 is provided on the rear surface of the outer frame 113, which is the opposite side of the flat portion 114. The first hook 133 protrudes toward the inner frame 120. A plurality of the first hooks 133 may be installed along a circumference of an inner end of the first handle portion 131.

The plurality of first hooks 133 is spaced apart from one another at equal intervals along the circumference of the inner end of the first handle portion 131. The plurality of first hooks 133 is spaced apart from the inner end of the first handle portion 131 in an adjacent manner.

A through-hole 136 may be formed between the plurality of first hooks 133 and the inner end of the first handle portion 131.

Here, the through-hole 136 may have the following purposes.

First, the through-hole 136 is provided to smoothly remove a mold from the first hook 133 when removing the mold after injection molding of the outer frame 113.

Second, the through-hole 136 allows synthetic resin to be smoothly supplied to a molding portion of the first hook 133 during injection molding of the outer frame 113.

Third, the through-hole 136 allows the first hook 133 to be elastically deformed when the first hook 133 and the second hook 134 are fastened together. The first hook 133 may be elastically deformed by the through-hole 136.

The through-hole 136 may be provided in plurality so as to correspond to the plurality of first hooks 133. The plurality of through holes 136 forms through the flat portion 114 of the outer frame 113 in a thickness direction.

With this configuration, a mold may be inserted from the front to rear of the flat portion 114 of the outer frame 113 through the through-hole 136 in a penetrating manner, and be then extracted through the through-hole 136 after injection molding using synthetic resin.

Each of the first hooks 133 may include a hook body 1331 and a hook protrusion 1332.

The hook body 1331 protrudes rearward from the rear surface of the outer frame 113.

The hook body 1331 may have a plate shape with a constant thickness. The hook body 1331 may extend along a circumference of the inner end of the first handle portion 131.

For example, upper and lower ends of the first handle portion 131 (see FIG. 11) may be rounded in an arcuate shape. Hook bodies 1331 of the first hooks 133 respectively located at upper and lower ends of the first handle portion 131 may extend in a rounded manner.

A middle part of the first handle portion 131 may extend along a circumferential direction of a center of the outer frame 113 in a widthwise direction. Hook bodies 1331 of the first hooks 133 located at the middle of the first handle portion 131 may each have a curvature less (or smaller) than a curvature of the hook bodies 1331 respectively located at the upper and lower ends of the first handle portion 133, or extend substantially linearly.

The through-hole 136 may have a narrow width and a long length. The plurality of through-holes 136 may be spaced apart from each other at equal intervals along a circumference of the inner end of the first handle portion 131.

A width of the hook body 1331 may gradually decrease in its protruding direction.

The hook protrusion 1332 may protrude radially outward of the outer frame 113 from an end of the hook body 1331 so as to have a wedge shape. The wedge shape of the hook protrusion 1332 may be a shape of a cross section of a right (or right-angled) triangle.

The hook body 1331 and the hook protrusion 1332 may protrude higher than a height of the inner end of the first handle portion 131.

The hook protrusion 1332 may extend in a direction in which the hook body 1331 extends. An extended length of the hook protrusion 1332 may be less than an extended length of the hook body 1331.

The plurality of hook bodies 1331 and the plurality of hook protrusions 1332 may have different lengths.

A rib 137 may be formed at an opposite side of each of the through-holes 136 with the hook body 1331 interposed therebetween.

Each of the plurality of ribs 137 may protrude from one surface of the hook body 1331 to reinforce strength of the first hook 133. The rib 137 may have a plate shape. The rib 137 may protrude from the hook body 1331 in a direction opposite to the protruding direction of the hook protrusion 1332.

The rib 137 may extend in a direction that crosses or intersects the extended direction of the hook body 1331. The rib 137 may have a right triangle shape. A lower surface of the rib 137 may be integrally connected to the rear surface of the flat portion 114 of the outer frame 113, and a height surface of the rib 137 may be integrally connected to one surface of the hook body 1331.

An outer end of the first handle portion 131 and a radial outer end of the outer frame 113 may be disposed on the same circumference.

An inner end of the first handle potion 131 may be round toward the second handle portion 132 from a radial inner side of the outer frame 113.

The inner end of the first handle portion 131 and an inner end of the second handle portion 132 are configured to meet or contact each other without a step.

Since there is no step between connection portions of the first handle portion 131 and the second handle portion 132, the handle 130 may have an enhanced look and give the user a soft feeling without a sense of foreignness (or discomfort) when touched.

The second hook 134 may protrude radially inward of the inner frame 120 from the inner end of the second handle portion 132, toward the hook protrusion 1332 of the first hook 133. The second hook 134 may have a wedge shape.

The second hook 134 may extend along a circumference of the inner end of the second handle portion 132. Unlike the plurality of first hooks 133, the second hook 134 configured as one in number may be continuously formed along an entire length of the inner end of the second handle portion 132.

The second hook 134 may protrude toward the through-hole 136 from the inner end of the second handle potion 132 so as to radially overlap the inner end of the first handle portion 131.

This may allow a portion or part of the second hook 134 to be covered by the inner end of the first handle portion 131 without being exposed to an outside of the door frame 112.

The second hook 134 may protrude toward the hook protrusion 1332 of the first hook 133 to be engaged therewith.

The hook protrusion 1332 of the first hook 133 and the second hook 134 may each protrude to have a rectangular cross section.

The hook protrusion 1332 of the first hook 133 is provided with a first inclined surface 1333 and a first engagement surface 1334.

The first inclined surface 1333 may be inclined toward the inner end of the second handle portion 132 from a horizontal plane that passes through the hook body 1331 of the first hook 133.

The first engagement surface 1334 may vertically extend from the hook body 1331 of the first hook 133. The first engagement surface 1334 may be spaced apart from the inner end of the first handle portion 131 with a predetermined gap.

The second hook 134 is provided with a second inclined surface 1342 and a second engagement surface 1343.

The second inclined surface 1342 may be inclined toward the first engagement surface 1334 of the hook protrusion 1332 of the first hook 133 from a horizontal plane of the inner end of the second handle portion 132.

As the first inclined surface 1333 and the second inclined surface 1342 come in surface contact with each other when the first hook 133 and the second hook 134 are fastened together, the first hook 133 may be elastically deformed radially inward with respect to the second hook 134.

The second engagement surface 1343 may vertically extend from the inner end of the second handle portion 132.

The second engagement surface 1343 and the first engagement surface 1334 may be disposed to face each other in the back-and-forth direction. The first engagement surface 1334 and the second engagement surface 1343 may be meet each other to be engaged and coupled together.

As the first engagement surface 1334 and the second engagement surface 1343 are in surface contact in the vertical direction, the first hook 133 and the second hook 134 may be securely engaged with each other.

When the first and second engagement surfaces 1334 and 1343 are coupled to each other, the first hook 133 is covered by the second handle portion 132 without being exposed to an outside of the handle 130, thereby achieving an enhanced appearance.

When assembling the outer frame 113 and the inner frame 120 together, the outer frame 113 and the inner frame 120 may be moved (or pressed) toward each other in the back-and-forth direction to be assembled.

For example, when the inner frame 120 is pressed forward, namely, toward the outer frame 113, the coupling protrusion 123 of the outer frame 113 may be inserted into the protrusion accommodating portion 124 of the inner frame 120.

The second inclined surface 1342 of the second hook 134 is brought into contact with the first inclined surface 1333 of the first hook 133. As the second inclined surface 1342 pushes the first inclined surface 1333 radially inward, the hook body 1331 of the first hook 133 is elastically deformed radially inward. The inner end of the first handle portion 131 and the first engagement surface 1334 are away from other, causing a gap therebetween to be increased.

The second hook 134 passes through the widened gap to be inserted into the inner end of the first handle portion 131, toward the through-hole 136.

Here, as pressure applied to the hook protrusion 1332 of the first hook 133 is released, the first hook 133 is returned to its original position by an elastic force. Accordingly, the gap between the first engagement surface 1334 of the hook protrusion 1332 of the first hook 133 and the inner end of the first handle portion 131 is decreased to its original gap.

Subsequently, the first engagement surface 1334 of the hook protrusion 1332 of the first hook 133 rises and is engaged with the second engagement surface 1343 of the second hook 134 to be coupled.

The first hook 133 has a cantilever structure and is formed as a beam so that one end is fixed to the rear surface of the flat portion 114 of the outer frame 113 and another end is not fixed, making it easier to be elastically deformed.

The rib 137 that supports the hook body 1331 of the first hook 133 may reinforce rigidity by compensating a support force of the outer frame 113 against elastic deformation of the first hook 133.

A coupling groove 1341 may be formed on an outer circumferential surface of the second hook 134, which is an opposite side of the hook protrusion 1332 of the first hook 133, to extend along the inner end of the second handle portion 132. The inner end of the first handle portion 131 may be coupled to the coupling groove 1341.

As a thickness of the inner end of the first handle portion 131 corresponds to a depth of the coupling groove 1341, the first handle portion 131 and the second handle portion 132 may be coupled to each other as one curved surface without any step.

A plurality of guide protrusions 135 may protrude from an end of the second hook 134. Each of the plurality of guide protrusions 135 may protrude toward a space between adjacent hook protrusions 1332 of the respective first hooks 133.

The plurality of hook protrusions 1332 of the respective first hooks 133 and the plurality of guide protrusions 135 may be alternately disposed along the inner ends of the first handle portion 131 and the second handle portion 132.

The guide protrusion 135 may extend to correspond to a distance between hook protrusions 1332 located adjacent to each other. The guide protrusion 135 is configured to guide a position of the second hook 134 to which the hook protrusion 1332 of the first hook 133 is fastened.

A plurality of reinforcing ribs 138 may be provided on an inner surface of the second handle portion 132. The plurality of reinforcing ribs 138 may protrude radially inward from the inner surface of the second handle portion 132.

The plurality of reinforcing ribs 138 may be spaced apart from each other along a circumference of the inner end of the second handle portion 132. The plurality of reinforcing ribs 138 may extend from an outer end of the second handle portion 132 to the inner end of the second handle portion 132.

One side of the reinforcing rib 138 may be connected to an inner surface of the inner frame 120 that defines a boundary with the outer end of the second handle portion 132 in a contact manner, and another side of the reinforcing rib 138 may be connected to the second engagement surface 1343 of the second hook 134 in a contact manner.

The plurality of first hooks 133 and the plurality of reinforcing ribs 138 may be alternately disposed in a circumference direction of the inner ends of the first and second handle portions 131 and 132.

Rigidity of the second handle portion 132 may be reinforced or enhanced by the plurality of reinforcing ribs 138.

According to the present disclosure, as the handle 130 is recessed radially inward from the side surface of the door frame 112, an installation space of the handle 130 may be achieved without installing the handle 130 on the front surface of the door frame 112 on which the front glass 111 is installed.

Also, as the front cover 102 is curved such that its central portion protrudes more than its both ends, more portions of the side surface of the door frame 112 may be covered. Accordingly, the handle 130 may be implemented as a pocket that is recessed radially inward from the side surface of the outer frame 113 that protrudes outward of the main body 100, allowing a space for putting fingers to be acquired or secured even when a gap between the outer circumferential surface of the door frame 102 and the front cover 102 is narrow.

As the handle 130 is provided on the upper portion of the door frame 112, a waist bending angle that the user has to bend down to open or close the door 110 may be minimized.

In addition, in order to couple the first handle portion 131 and the second handle portion 132 to each other, the plurality of first hooks 133 protrudes along the inner end of the first handle portion 113 that is recessed from the outer frame 113, and the second hook 134 protrudes along the inner end of the second handle portion 132 that is recessed from the inner frame 120, and thus the first hooks 133 and the second hook 134 are engagingly fastened to each other, allowing the first handle portion 131 and the second handle portion 132 to be securely coupled to each other.

As the second hook 134 is inserted through the gap between the hook protrusion 1332 of the first hook 133, which is inwardly spaced apart from the inner end of the first handle portion 131, and the inner end of the first handle portion 131, a fastening force between the first hook 133 and the second hook 134 may be increased.

As the plurality of guide protrusions 135 is formed at the end of the second handle portion 132 and protrudes between the plurality of first hooks 133 to guide positions where the first hooks 133 and the second hook 134 are engagingly coupled to each other, assemblability may be improved.

As the plurality of through-holes 136 is formed through the outer frame 113 on which the plurality of first hooks 133 is provided in the thickness direction, a mold may be easily removed after injection molding of the plurality of first hooks 133. In addition, as the first hook 133 overlaps the through-hole 136 in the thickness direction, the first hooks 133 may be elastically deformed when the first hooks 133 and the second hook 134 are fastened together.

Further, each of the plurality of first hooks 133 includes the hook body 1331 that protrudes from the rear surface of the outer frame 113 and the hook protrusion 1332 that protrudes from the end of the hook body 1331 toward the second hook 134. The hook protrusion 1332 includes the first inclined surface 1333 that is inclined toward the inner end of the second handle portion 132 from the hook body 1331 and the first engagement surface 1334 that vertically extends toward the inner end of the second handle portion 132 from the hook body 1331. The second hook 134 includes the second inclined surface 1342 that is inclined from the inner end of the second handle portion 132 to be in surface contact with the first inclined surface 1333, and the second engagement surface 1343 that is vertically formed to be in surface contact with the first engagement surface 1334. With this configuration, when the first hooks 133 and the second hook 134 are fastened together, the second inclined surface 1342 may be disposed at an outside of the first inclined surface 1333 to come in surface contact, allowing the first inclined surface 1333 to be elastically pressed radially inward. In addition, as the first engagement surface 1334 and the second engagement surface 1343 come in surface contact with each other in the vertical direction, a coupling force may be further increased.

Moreover, as the hook body 1331 of the first hook 133 is configured to be elastically deformed in a direction opposite to the protruding direction of the hook protrusion 1332, and the rib 137 vertically protrudes from the rear surface of the hook body 1331, rigidity of the hook body 1331 may be reinforced.

Furthermore, as the second handle portion 132 is recessed radially inward of the inner frame 120, the second handle portion 132 is configured to be elastically deformed radially outward of the inner frame 120 when coupled with the first handle portion 131, and the plurality of reinforcing ribs 138 protrudes radially inward from the rear surface of the second handle portion 132, rigidity of the second handle portion 132 may be reinforced.

What is claimed is:

1. A laundry treating apparatus, comprising:

a main body comprising a front cover, the front cover defining a laundry inlet port; and a door rotatably disposed at the front cover and configured to open and close the laundry inlet port, the door comprising:

an outer frame facing away from the main body, a front glass disposed at a front surface of the outer frame, an inner frame that is coupled to a rear surface of the outer frame and faces the main body, and a handle comprising (i) a first handle portion that is recessed from a side surface of the outer frame and (ii) a second handle portion that is recessed from a side surface of the inner frame, wherein outer ends of the first handle portion and the second handle portion are spaced apart from each other to thereby define a space configured to receive fingers of a user, and wherein inner ends of the first handle portion and the second handle portion are coupled to each other.

2. The apparatus of claim 1, wherein the handle is located vertically above a center line that horizontally passes through centers of the outer frame and the inner frame.

3. The apparatus of claim 1, wherein:

the first handle portion is recessed radially inward from the side surface of the outer frame and extends toward the front glass, the first handle portion being open radially outward of the outer frame and extending toward the inner frame;

the second handle portion is recessed radially inward from the side surface of the inner frame, the second handle portion being open radially outward of the inner frame and extending in a front-and-rear direction; and the first handle portion and the second handle portion are coupled to each other to thereby define the space configured to receive the fingers of the user.

4. The apparatus of claim 1, wherein the outer frame comprises:

a flat portion in contact with the front glass;

a mounting guide that protrudes from an outer circumferential portion of the flat portion and surrounds an outer circumferential surface of the front glass; and a side portion that protrudes from the outer circumferential portion of the flat portion toward the inner frame, and wherein the inner frame comprises an outer circumferential portion that is coupled to and in contact with the side portion of the outer frame, the outer circumferential portion of the inner frame having a curved shape that is convex in a radial direction and extends rearward relative to the side portion.

5. The apparatus of claim 4, wherein:

the first handle portion is recessed radially inward from the side portion of the outer frame toward a rear surface of the flat portion; and the second handle portion is recessed radially inward from the outer circumferential portion of the inner frame, the second handle portion extending through the outer circumferential portion of the inner frame in a front-and-rear direction and being in communication with the first handle portion.

6. The apparatus of claim 1, wherein the front cover is curved such that a central portion of the front cover protrudes forward relative to left and right ends of the front cover with respect to a vertical center line passing through a center of the laundry inlet port in an up-and-down direction.

7. The apparatus of claim 1, wherein the front cover comprises a recess portion that surrounds the laundry inlet port and that is recessed from a front surface of the front cover toward an inside of the main body, and wherein a portion of the door protrudes forward relative to the recess portion.

8. The apparatus of claim 7, wherein:

the first handle portion is radially recessed from the side surface of the outer frame and spaced apart from the recess portion; and the second handle portion is radially recessed from the side surface of the inner frame, wherein at least a portion of the second handle portion is covered by the recess portion.

9. The apparatus of claim 7, wherein the inner frame comprises a protruding portion that is disposed at a rear surface of the inner frame and inserted into the recess portion of the front cover.

10. A laundry treating apparatus comprising:

a main body comprising a front cover, the front cover defining a laundry inlet port; and a door rotatably disposed at the front cover and configured to open and close the laundry inlet port, the door comprising:

an outer frame facing away from the main body, a front glass disposed at a front surface of the outer frame, an inner frame that is coupled to a rear surface of the outer frame and faces the main body, and a handle recessed from a side surface of the outer frame and a side surface of the inner frame, the handle defining a space configured to receive fingers of a user, wherein the handle comprises:

a first handle portion that is defined at the rear surface of the outer frame and configured to be caught by the fingers based on the user pulling the door away from the main body, and a second handle portion that is defined at the inner frame and in communication with the first handle portion, the second handle portion being configured to guide the fingers to the first handle portion.

11. The apparatus of claim 10, wherein the second handle portion has a curved shape that is convex radially inward of the inner frame.

12. The apparatus of claim 10, wherein the second handle portion comprises a plurality of reinforcing ribs that protrude from an inner surface of the second handle portion and are configured to reinforce rigidity of the second handle portion, and wherein the second handle portion is configured to deform in a direction opposite to a recessed direction of the second handle portion based on the second handle portion being coupled to the first handle portion.

13. A laundry treating apparatus comprising:

a main body comprising a front cover, the front cover defining a laundry inlet port; and a door rotatably disposed at the front cover and configured to open and close the laundry inlet port, the door comprising:

an outer frame facing away from the main body, a front glass disposed at a front surface of the outer frame, an inner frame that is coupled to a rear surface of the outer frame and faces the main body, and a handle recessed from a side surface of the outer frame and a side surface of the inner frame, the handle defining a space configured to receive fingers of a user, wherein the handle comprises:

a first handle portion that is recessed radially inward from the side surface of the outer frame, and a second handle portion that is recessed radially inward from the side surface of the inner frame, and wherein the handle further comprises a plurality of hooks that couple the first handle portion and the second handle portion to each other, the plurality of hooks comprising:

a plurality of first hooks that protrude rearward from an inner rear side of the outer frame toward the inner frame, and a second hook that protrudes from an inner end of the second handle portion and is coupled to the plurality of first hooks.

14. The apparatus of claim 13, further comprising a plurality of guide protrusions that protrude from the second hook and are disposed between the plurality of first hooks, wherein the plurality of first hooks are spaced apart from one another and arranged along an inner end of the first handle portion, wherein the plurality of guide protrusions are configured to guide coupling of the second hook to the plurality of first hooks.

15. The apparatus of claim 13, further comprising a plurality of through-holes defined through the outer frame in a thickness direction of the outer frame and disposed between an inner end of the first handle portion and the plurality of first hooks, wherein each of the plurality of through-holes overlaps a hook protrusion that protrudes from one of the plurality of first hooks in the thickness direction.

16. The apparatus of claim 13, wherein each of the plurality of first hooks comprises:

a hook body that protrudes rearward from the rear surface of the outer frame; and a hook protrusion that protrudes from an end of the hook body toward the second hook, the hook protrusion being spaced apart from an inner end of the first handle portion, and wherein the second hook is inserted into a gap defined between the inner end of the first handle portion and the hook protrusion.

17. The apparatus of claim 16, wherein the hook protrusion comprises:

a first inclined surface that is inclined with respect to the hook body and extends to the inner end of the second handle portion, the first inclined surface being in contact with the inner end of the second handle portion;

a first engagement surface that vertically extends from the hook body toward the inner end of the second handle portion, and wherein the second hook comprises:

a second inclined surface that extends from the inner end of the second handle portion toward the first handle portion, the second inclined surface being configured to apply force to the first inclined surface, and a second engagement surface that extends vertically from the inner end of the second handle portion and is in contact with the first engagement surface.

18. The apparatus of claim 16, wherein each of the plurality of first hooks further comprises a rib that protrudes from a rear surface of the hook body and is configured to reinforce rigidity of the hook body, and wherein the hook body is configured to deform in a direction opposite to a protruding direction of the hook protrusion based on the plurality of first hooks being coupled to the second hook.

19. The apparatus of claim 13, wherein the second handle portion has a curved shape that is convex radially inward of the inner frame.

20. The apparatus of claim 13, wherein the second handle portion comprises a plurality of reinforcing ribs that protrude from an inner surface of the second handle portion and are configured to reinforce rigidity of the second handle portion, and wherein the second handle portion is configured to deform in a direction opposite to a recessed direction of the second handle portion based on the second handle portion being coupled to the first handle portion.

* * * * *